US007591244B2

(12) United States Patent
Auffret et al.

(10) Patent No.: US 7,591,244 B2
(45) Date of Patent: Sep. 22, 2009

(54) CONTROL METHOD FOR THE INTAKE AND EXHAUST VALVES OF AN ENGINE AND INTERNAL COMBUSTION ENGINE COMPRISING SUCH VALVES

(75) Inventors: Nicolas Auffret, Lyons (FR); Nicolas Dronniou, Lyons (FR)

(73) Assignee: Renault Trucks, Saint-Priest (FR)

( * ) Notice: Subject to any disclaimer, the term of this patent is extended or adjusted under 35 U.S.C. 154(b) by 0 days.

(21) Appl. No.: 12/064,214

(22) PCT Filed: Aug. 18, 2005

(86) PCT No.: PCT/EP2005/009892

§ 371 (c)(1),
(2), (4) Date: Mar. 31, 2008

(87) PCT Pub. No.: WO2007/019879

PCT Pub. Date: Feb. 22, 2007

(65) Prior Publication Data

US 2008/0223333 A1 Sep. 18, 2008

(51) Int. Cl.
*F02D 9/06* (2006.01)

(52) U.S. Cl. ..... 123/321

(58) Field of Classification Search ..... 123/321
See application file for complete search history.

(56) References Cited

U.S. PATENT DOCUMENTS 5,619,965 A 4/1997 Cosma et al.
5,647,318 A 7/1997 Feucht et al.
5,829,397 A * 11/1998 Vorih et al. ..... 123/90.12
5,996,550 A * 12/1999 Israel et al. ..... 123/322
6,000,374 A 12/1999 Cosma et al.
6,178,946 B1 * 1/2001 Matthews et al. ..... 123/322

(Continued)

FOREIGN PATENT DOCUMENTS

EP 0791729 A 8/1997

(Continued)

OTHER PUBLICATIONS

International Search Report for International Patent Application PCT/EP2005/009892, dated Apr. 20, 2006.

(Continued)

*Primary Examiner*—Erick Solis
(74) *Attorney, Agent, or Firm*—Novak Druce & Quigg LLP

(57) ABSTRACT

This method is for controlling the intake and exhaust valves of the cylinders of an internal combustion engine which is capable of operating either in four-stroke positive mode or in two-stroke braking mode. The control means pilot the valves so that at least a first exhaust valve of each cylinder (1) is opened ($C_{43}$) prior to a first instant ($t_1$) when the piston of said cylinder reaches its top dead center position and so that the first exhaust valve is kept in an open state ($C_{43}$) with a first lift ($L_1$) and for a first predetermined period of time ($\Delta t_1$), prior to said first instant ($t_1$), and at least an exhaust valve is kept in an open state, with a second lift ($L_2$) higher than the first lift and for a second predetermined period of time ($\Delta t_2$), after the first instant ($t_1$).

5 Claims, 4 Drawing Sheets

U.S. PATENT DOCUMENTS

| | | | | |
|---|---|---|---|---|
| 6,189,504 | B1 * | 2/2001 | Israel et al. | 123/321 |
| 6,223,846 | B1 | 5/2001 | Schechter | |
| 6,237,551 | B1 | 5/2001 | Macor et al. | |
| 6,418,720 | B1 | 7/2002 | Cornell et al. | |
| 6,439,195 | B1 * | 8/2002 | Warner | 123/321 |
| 7,284,533 | B1 * | 10/2007 | Huang et al. | 123/321 |
| 2003/0200945 | A1 | 10/2003 | Saruwatari et al. | |

FOREIGN PATENT DOCUMENTS

| | | | |
|---|---|---|---|
| WO | 20030031778 | A | 4/2003 |

OTHER PUBLICATIONS

Written Opinion of the International Searching Authority; International Patent App. No. PCT/EP2005/009892; mailed Apr. 28, 2006.

* cited by examiner

CONTROL METHOD FOR THE INTAKE AND EXHAUST VALVES OF AN ENGINE AND INTERNAL COMBUSTION ENGINE COMPRISING SUCH VALVES

TECHNICAL FIELD OF THE INVENTION

This invention concerns a method for controlling the intake and exhaust valves of the cylinders of an internal combustion engine which is capable of operating either in positive mode or in braking mode. This invention also concerns such an internal combustion engine.

BACKGROUND OF THE INVENTION

Some internal combustion engines are known to be capable of being used either in a positive mode, where they generate power, or in a compression release engine braking mode, where they are used to slow down the vehicle on which they are mounted. For example, U.S. Pat. No. 5,619,965 discloses a internal combustion engine which can operate in a two-stroke braking mode where the inlet and exhaust valves of each cylinder are open to fill each cylinder with air to be compressed by the movement of its piston between its bottom dead centre position and its top dead centre position. EP-A-0 781 729 describes an engine that can be switched from a four-stroke power mode to a two-stroke braking mode and which includes an auxiliary valve open to a bleed conduit when the piston is in the vicinity of its top dead centre. U.S. Pat. No. 6,000,374 discloses a multi-cycle engine which can be switched from a power generating mode to a braking mode. This braking mode is different from a two-stroke mode since the valves are opened differently after two consecutive passages of the piston in its top dead centre position.

In all these prior art engines, the braking power obtained is quite low, which means that slowing down of a vehicle might be longer than expected.

SUMMARY OF THE INVENTION

This invention aims at proposing an optimized method for the control of the intake and exhaust valves of an internal combustion engine, which provides high braking power.

The invention concerns a method for controlling the intake and exhaust valves of the cylinders of an internal combustion engine which is capable of operating either in positive mode or in braking mode, said engine comprising control means for said valves, said control means being adapted to establish a first four-stroke timing sequence of the valves of each cylinder, for the positive mode of said engine, and a second two-stroke timing sequence of said valves, for the braking mode of said engine, said control means piloting said valves so that at least a first exhaust valve of each cylinder is opened prior to a first instant when the piston of said cylinder reaches its top dead centre position. This method is characterized in that, during the second timing sequence, the exhaust valves are piloted by said control means so that:

- the first exhaust valve is kept in an open state, with a first lift and for a first predetermined period of time, prior to the first instant, and
- at least an exhaust valve is kept in an open state, with a second lift higher than said first lift and for a second predetermined period of time, after the first instant.

Hereafter, the top dead centre position of a piston in the corresponding cylinder is noted "TDC" and the bottom dead centre position of such a piston is noted "BDC".

Thanks to the invention, the exhaust valve, which is kept open before the piston reaches TDC, allows a limitation of the peak cylinder pressure just before the piston reaches TDC. This enables to take into account the maximum pressure for which the engine is designed, in particular the cylinder body and the corresponding cylinder head. Since an exhaust valve is kept in an open state with a second lift higher than the first lift after the piston reaches TDC, gazes compressed in the cylinder can be evacuated very quickly.

According to further aspects of the invention, such a method might incorporate one or several of the following features:

- The control means pilot the first exhaust valve so that its opening lift is increased to the second lift for said second period of time. In such case, two valves can be opened prior to the first instant and kept open with the first lift during the first period of time and with the second lift during the second period of time.
- The control means close the first exhaust valve after the first period and open a second exhaust valve before the first instant, said second valve being kept in its open state during the second predetermined period of time.
- Each exhaust valve is kept in a closed state, after the second period of time, at least up to when said piston reaches, during its upward stroke, a position where said first valve is opened.
- At least an exhaust valve is opened and is kept in an open state for a third predetermined period of time, including the instant when the piston reaches its bottom dead center position.
- An intake valve is opened and is kept in an open state for a fourth predetermined period of time, after said second period of time and prior to a second instant when said piston reaches its bottom dead center position.

The invention also concerns an internal combustion engine with which a method as mentioned here-above can be used. More precisely, such an engine comprises a plurality of cylinders, each of which is provided with at least one intake valve and at least one exhaust valve, and control means for said valves, said control means being adapted to establish a first four-stroke timing sequence of the valves of each cylinder for the positive mode of said engine, and a second two-stroke timing sequence of said valves for the braking mode of said engine, said control means piloting said valves in said second timing sequence so that at least a first exhaust valve of each cylinder is opened prior to a first instant where the piston of this cylinder reaches its TDC. This engine is characterized in that, during the second timing sequence, the control means pilot the exhaust valves so that:

- the first exhaust valve is kept in an open state, with a first lift and for a first predetermined period of time, prior to the first instant, and
- at least an exhaust valve is kept in an open state, with a second lift higher than the first lift and for a second predetermined period of time, after the first instant.

According to a first embodiment of the invention, the exhaust valve which stays in a first open state during the second period of time is the first exhaust valve, which is adapted to be opened with two different lifts. Two exhaust valves might stay in a first open state during the first period of time and in a second open state during the second period of time.

According to another embodiment of the invention, the exhaust valve which stays in an open state during the second period of time is different from the first exhaust valve, each valve being adapted to be opened with one lift.

BRIEF DESCRIPTION OF THE DRAWINGS

The invention will be explained in correspondence with the annexed figures and as an illustrative example, without restricting the object of the invention. In the annexed figures.

DETAILED DESCRIPTION OF SOME EMBODIMENTS

Figure 1:
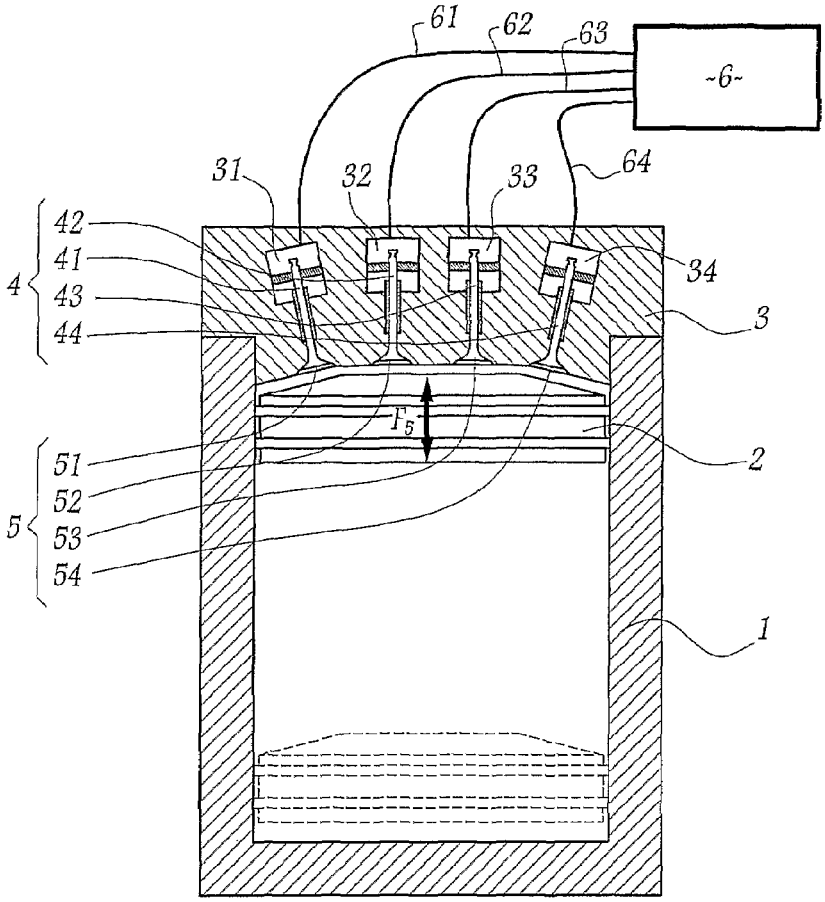
FIG. 1 is a schematic view representing a cylinder of an internal combustion engine according to the invention.

The cylinder 1 represented on FIG. 1 belongs to a multi-cylinder internal combustion Diesel type engine according to the invention and includes a piston 2 movable, as shown by arrow $F_1$, between a top dead centre position shown on FIG. 1 with continuous lines and a bottom dead centre position represented in dashed lines. The cylinder head 3 is equipped with a set 4 of four valves, namely two intake valves 41 and 42 and two exhaust valves 43 and 44. Each valve is movable with respect to a seat 51, 52, 53, 54 belonging to a set 5 of seats defined by head 3.

The movement of each valve with respect to its seat is controlled, independently of the engine speed, by a central control unit 6. As shown on FIG. 1, control unit 6 is connected by four control lines 61, 62, 63 and 64 to four cavities 31, 32, 33 and 34 provided in cylinder head 3. Oil under pressure can be injected into these cavities to move each valve away from its seat, against the action of a non-represented spring. In other words, control unit 6 belongs to camless control means which can actuate the valves 41 to 44 independently of the speed of the engine and of the crank angle.

Other camless control means can be used in an engine and with a method according to the invention, e.g. electrical control means. Moreover, control means actuated by the camshaft of the engine can also be used with the invention. In fact, any type of variable valve train or "VVT", which provides the engine with some flexibility for piloting the valves, can be used to drive valves 41 to 44 according the invention.

When the engine functions in a power generating mode, a four-stroke sequence is given to valves 41 to 44 by control unit 6.

Figure 2:
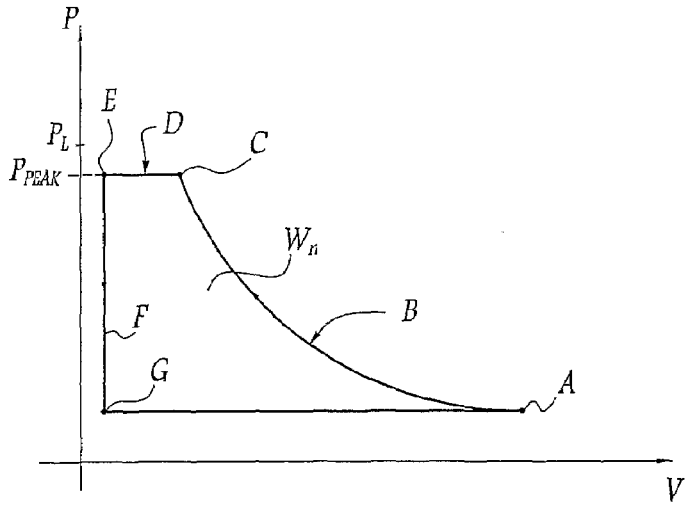
FIG. 2 is a theoretical diagram showing the negative work obtained by the movement of the piston when the engine operates in braking mode.

When the engine is switched to braking mode, the negative work $W_n$ obtained is as represented on FIG. 2, the abscises corresponding to the variable volume V defined in cylinder 1, between piston 2 and cylinder head 3, whereas the ordinates represent the pressure P within this volume. Starting from point A where a mass of gas is trapped within the cylinder when the piston is close to its BDC, a quasi-isentropic compression B takes place where P×V equals a constant. The braking power is achieved by compressing the gases within cylinder 1.

The peak cylinder pressure $P_{PEAK}$ is reached at point C and must be precisely controlled in order not to exceed a preset limit value $P_L$ which depends on the mechanical characteristics of the engine. Control of peak cylinder pressure $P_{PEAK}$ is needed to avoid engine mechanical problems resulting from the load on connecting rods, the pressure on cylinder head 3, the temperature of some injection nozzles, etc . . . Peak cylinder pressure $P_{PEAK}$ must be kept stable and as close as possible to $P_L$, which is shown on FIG. 2 by the horizontal line D between point C and point E.

Point E corresponds to the moment where piston 2 is in TDC. From this position, pressure must suddenly decrease, which corresponds to a fast blow down of the internal volume of cylinder 1, as shown by vertical line F on FIG. 2. One reaches then point G where the volume is increased up to the value of point A. This corresponds to the downward stroke of the piston.

Figure 3:
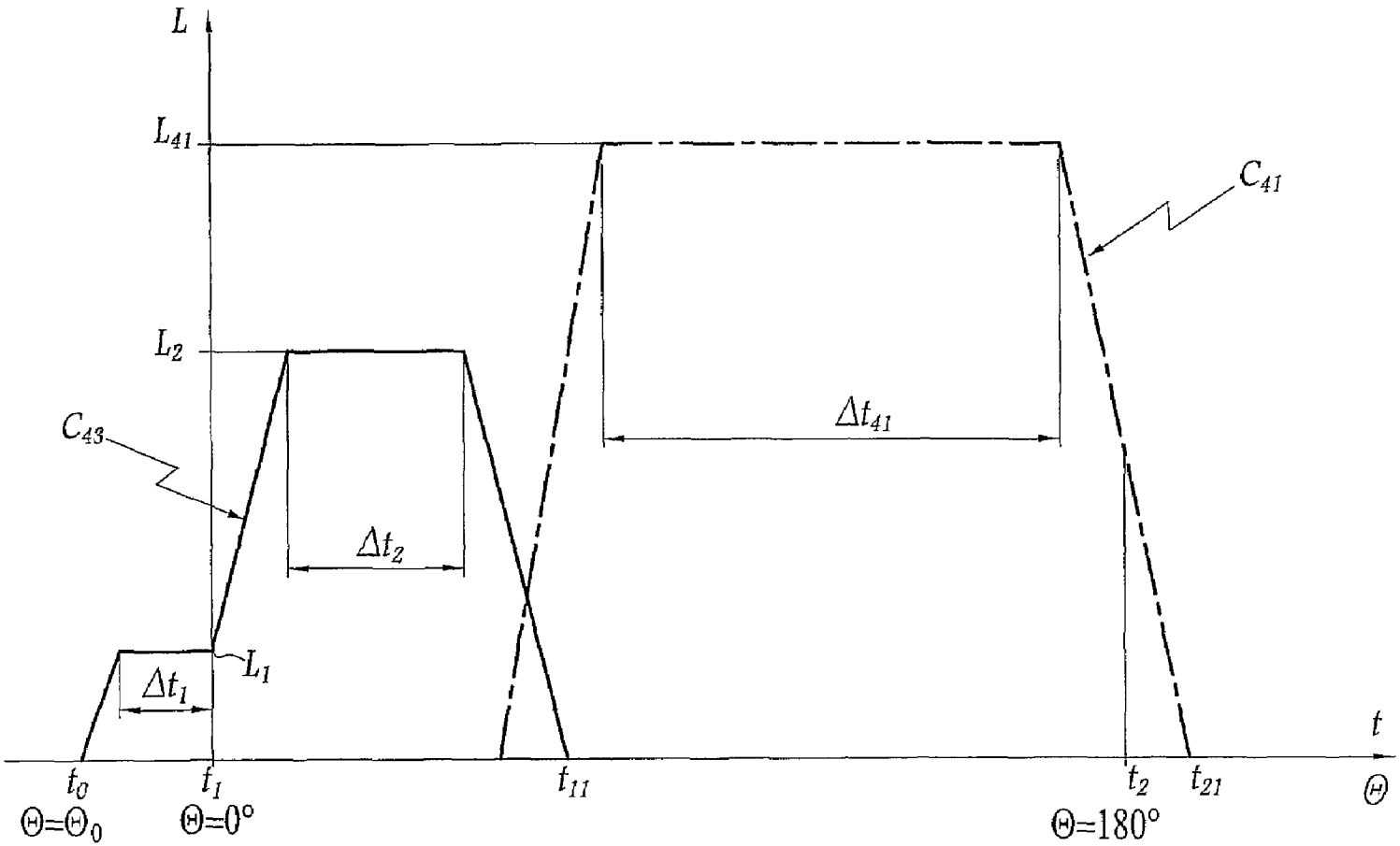
FIG. 3 is a diagram showing the lift of some of the valves of the cylinder of FIG. 1 depending on the time, for a first method according to the invention.

As shown on FIG. 3, which represents the lift L of some valves as a function of time t, exhaust valve 43 is opened before an instant $t_1$ which corresponds to the moment where the piston reaches TDC.

In fact, FIG. 3 can also be considered to be a representation of the lift L of some valves as a function of the crank angle θ of the engine, since this angle varies as a function of time, depending on the engine speed.

Figure 4:
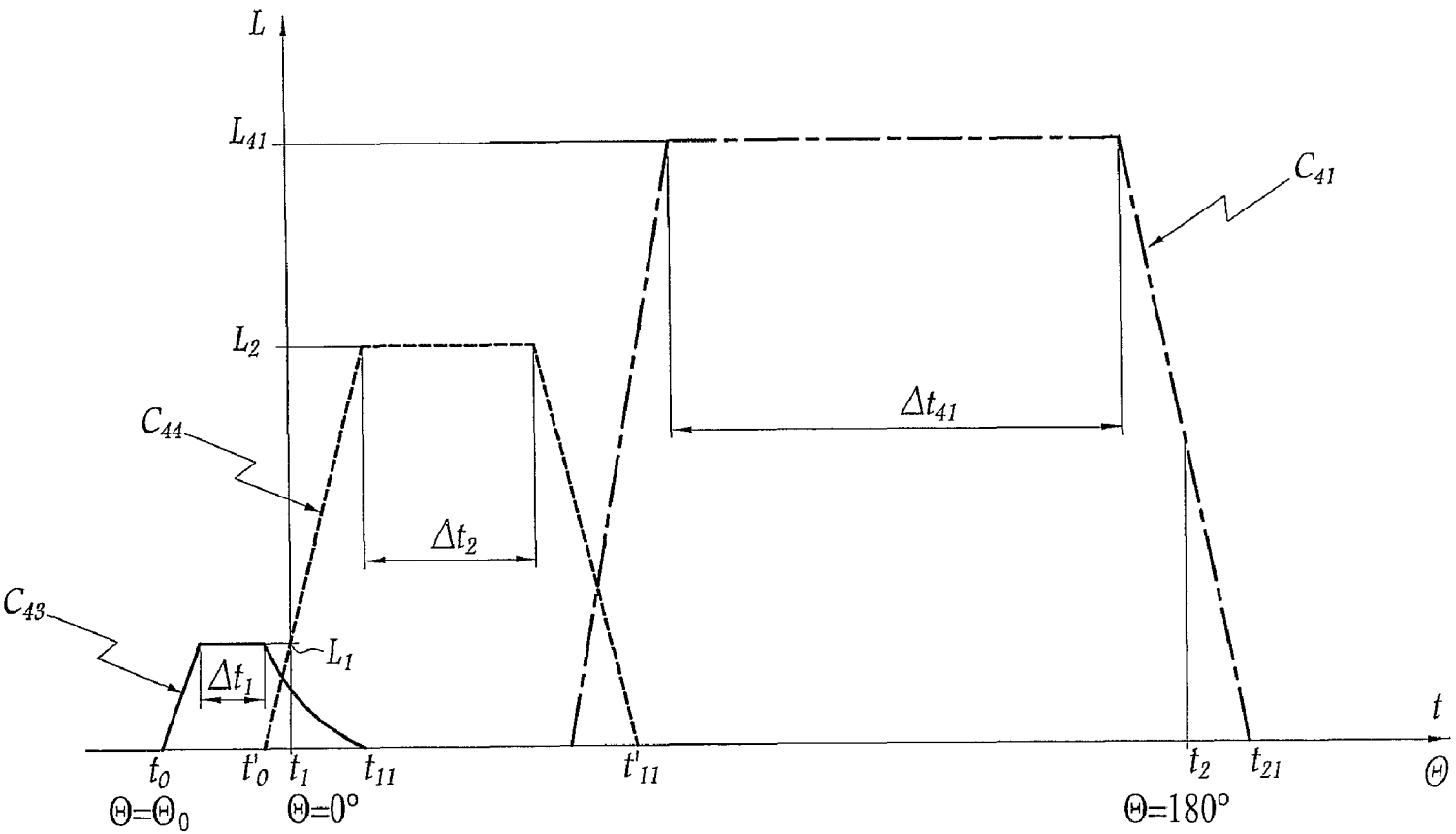
FIG. 4 is a diagram similar to FIG. 3, for a second method according to the invention.
Figure 5:
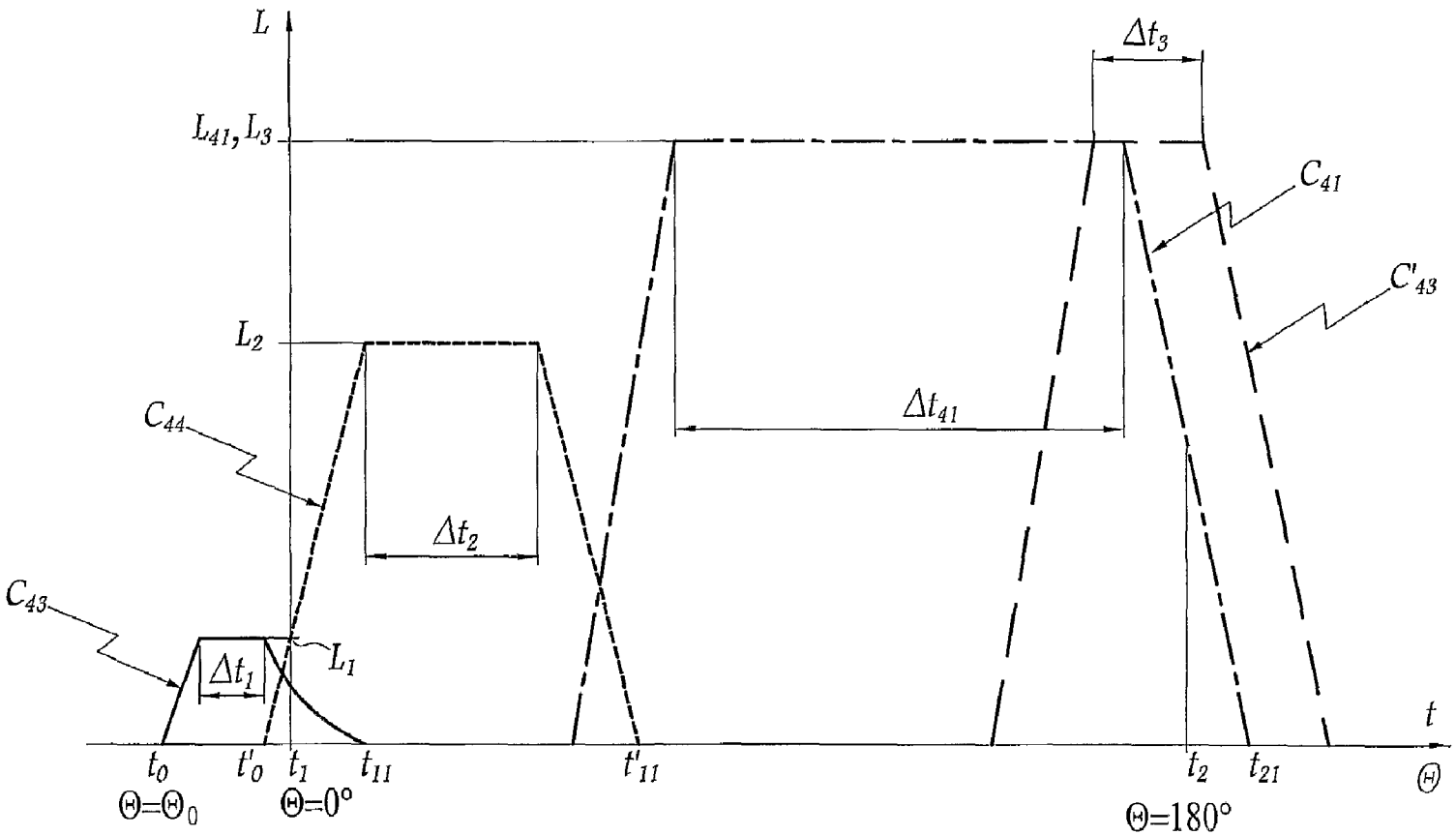
FIG. 5 is a diagram similar to FIG. 3, for a third method according to the invention.

On this figure and on FIGS. 4 and 5, one considers that a crank angle θ of 0° or 360° corresponds to TDC and a crank angle of 180° corresponds to BDC. Downward stroke of piston 2 corresponds to a crank angle θ between 0° and 180° and upward stroke corresponds to a crank angle θ between 180° and 360°.

As shown by curve $C_{43}$ on FIG. 3, valve 43 is first opened to a first lift $L_1$. Then valve 43 is kept in the corresponding open state for a period of time $\Delta t_1$ which takes place before instant $t_1$. Then, from instant $t_1$, the lift of valve 43 is increased up to a second value $L_2$ and valve 43 is kept in its second open state for a second period of time $\Delta t_2$ which takes place after instant $t_1$. $L_2$ is larger than $L_1$.

Opening of valve 43 starts at an instant to which corresponds to a crank angle $\theta_0$ between 180° and 360°, preferably between 300° and 360°.

Thanks to this way of controlling the opening of exhaust valve 43, peak cylinder pressure $P_{PEAK}$ can be limited during period $\Delta t_1$, as shown by straight line D on FIG. 2, this pressure being high, in order to use a high resistive load on the output shaft of the engine. Just after $t_1$, exhaust valve 43 is fully opened in order to quickly blow down cylinder 1, which corresponds to straight line F on FIG. 2. After period $\Delta t_2$, exhaust valve 43 is progressively closed up to an instant $t_{11}$ from which valves 43 and 44 remain closed up to the next time the crank shaft reaches angle of $\theta_0$, at $t_0$.

Alternatively, both exhaust valves 43 and 44 might be opened, with an opening law similar to the one represented by curve $C_{43}$ on FIG. 3.

Intake valve 41 is opened with a lift $L_{41}$, as shown by curve $C_{41}$, is kept in its open state for a period of time $\Delta t_{41}$ which takes place after period $\Delta t_2$. The value of $L_{41}$ can be smaller or larger than the value of $L_2$. As shown on FIG. 3, opening of valve 41 can start before final closing of valve 43. Closing of valve 41 starts before piston 2 reaches BDC at a second instant $t_2$. Final closing of valve 41 takes place after $t_2$, at an instant $t_{21}$. It can also occur before $t_2$, at an instant $t_{21}$ which is then prior to $t_2$. After $t_{21}$, exhaust valves 43 and 41 remain closed up to the next opening of valve 43 which takes place at $t_0$, just before the next instant $t_1$ as explained here-above. Intake valves 41 and 42 are kept in their closed state after instant $t_{21}$.

Opening of intake valve 41 allows to fill cylinder 1 with fresh air. Alternatively, both intake valves 41 and 42 can be opened during period $\Delta t_{41}$, which facilitates filling of cylinder 1 with fresh air.

According to this first method, a precise control of the peak cylinder pressure $P_{PEAK}$ is combined with an efficient cylinder blow down, thanks to the variable lift of exhaust valve 43.

In the second method represented in FIG. 4, exhaust valve 43 is first opened before instant $t_1$, for a first period $\Delta t_1$ as shown by curve $C_{43}$. Then, this valve is closed and reaches its fully closed position at instant $t_{11}$. Valve 44 is opened as from an instant $t'_0$, which is prior to instant $t_1$, and reaches, after $t_1$, an open state where its lift has a value $L_2$ higher than the opening lift value $L_1$ of valve 43. Valve 44 is then kept in its open state for a second period of time $\Delta t_2$. Then, it is progressively closed in the same way as valve 43 in the first method, up to instant $t'_{11}$.

Opening of the intake valve 41 is similar to what happens in the first method. Valve 42 can also be used.

In this method, one takes into account that a variable lift might be difficult to achieve with some existing exhaust valves. Here, the peak cylinder pressure is controlled by the opening of first exhaust valve 43, whereas fast blow down of cylinder 1 is obtained with second exhaust valve 44, each valve being opened with a single lift, $L_1$ or $L_2$.

This method needs two exhaust valves per cylinder,

In the third method represented on FIG. 5, opening of valves 43 and 44 is similar to what happens in the second method. In this method, exhaust valve 43 is re-opened, as shown by curve $C'_{43}$ when the piston is about to reach its BDC. Alternatively, both exhaust valves 43 and 44 might be opened at this stage.

Valve 43 is kept open with a lift $L_3$ for a third period of time $\Delta t_3$ which takes place before and after piston 2 reaches BDC at instant $t_2$. Lift $L_3$ can be higher than lift $L_2$.

This second opening of valve 43, and possibly valve 44, enables to fill the cylinder with hot gases in addition to the fresh air coming through the intake valves 41 and/or 42. Here, one uses the fact that pressure in the exhaust gas collector is higher than pressure in the inlet gas feeder. This increases the mass of trapped gas within cylinder 1, which increases the brake power obtained during the isentropic compression of gas represented by curve B on FIG. 2.

The second opening $C'_{43}$ of exhaust valve 43, and possibly valve 44, can also be used in a method where the first opening takes place with a single valve, as in the first method shown in FIG. 3.

The invention has been described when implemented on a Diesel type engine can be used with a regular gas engine.

On FIG. 1, set of valve 4 is represented with all valves in one plane, for the sake of clarity. Of course, the position of valves 41 to 44 can be different, e.g. with the four valves distributed around a central axis of cylinder 1.

LIST OF REFERENCES

| | | |
|---|---|---|
| 1 | cylinder | |
| 2 | piston | |
| 3 | cylinder head | |
| | 31 | cavity |
| | 32 | cavity |
| | 33 | cavity |
| | 34 | cavity |
| 4 | set of valves | |
| | 41 | intake valve |
| | 42 | intake valve |
| | 43 | exhaust valve |
| | 44 | exhaust valve |
| | 51 | seat for 41 |
| | 52 | seat for 42 |
| | 53 | seat for 43 |
| | 54 | seat for 44 |
| 5 | set of seats | |
| 6 | control unit | |
| | 61 | control line |
| | 62 | control line |
| | 63 | control line |
| | 64 | control line |
| $F_1$ | arrow | |
| A | point | |
| B | isentropic compression | |
| C | point | |
| D | control of high cylinder pressure | |
| E | point | |
| F | blow down of cylinder | |
| G | point | |
| L | lift of valves | |
| $L_1$ | first lift of valve 43 | |
| $L_2$ | second lift of valve 43 or valve 44 | |
| $L_3$ | third lift of valve 43 or valve 44 | |
| $L_{41}$ | lift of valve 41 | |
| P | pressure within 1 | |
| $P_L$ | limit value for P | |
| $P_{PEAK}$ | peak cylinder pressure | |
| t | time | |
| $t_0$ | instant | |
| $t'_0$ | instant | |
| $t_1$ | first instant | |
| $t_{11}$ | instant | |
| $t'_{11}$ | instant | |
| $t_2$ | second instant | |
| $t'_{21}$ | instant | |
| V | volume between 2 and 3 | |
| $W_n$ | negative work | |
| $\Delta t_1$ | first opening period | |
| $\Delta t_2$ | second opening period | |
| $\Delta t_3$ | third opening period | |
| $\Delta t_{41}$ | opening period for valve 41 | |
| $\theta$ | crank angle | |
| $\theta_0$ | value of $\theta$ at $t_0$ | |

The invention claimed is:

1. A method for controlling the intake valves (41, 42) and exhaust valves (43, 44) of the cylinders (1) of an internal combustion engine which is capable of operating either in positive mode or in braking mode, said engine comprising control means (6) for said valves (4), said control means being adapted to establish a first four-stroke timing sequence of the valves of each cylinder for the positive mode of said engine and a second two-stroke timing sequence of said valves for the braking mode of said engine, said control means piloting said valves so that at least a first exhaust valve (43, 44) of each cylinder (1) is opened prior ($t_0$) to a first instant ($t_1$) when the piston (2) of said cylinder reaches its top dead center position (TDC), characterized in that, during said second timing sequence, said exhaust valves (43, 44) are piloted by said control means (6) so that:

said first exhaust valve (43, 44) is kept in an open state with a first lift ($L_1$) and for a first predetermined period of time ($\Delta t_1$), prior to said first instant ($t_1$), and at least an exhaust valve (43 and/or 44) is kept in an open state, with a second lift ($L_2$) higher than said first lift and for a second predetermined period of time ($\Delta t_2$), after said first instant, wherein during said second timing sequence, said control means (6) close said first exhaust valve (43) after said first period ($\Delta t_1$), and open a second exhaust valve (44) before said first instant ($t_1$), said second valve being kept in its open state ($L_2$) during said second predetermined period of time ($\Delta t_2$).

2. The method according to claim 1, wherein during said second timing sequence, each exhaust valve (43, 44) is kept in a closed state, after said second period of time ($\Delta t_2$), at least up to when said piston reaches, during its upward stroke, a position ($\theta_0$) where said first valve is opened (at $t_0$).

3. The method according to claim 1, wherein during said second timing sequence, at least an exhaust valve (43, 44) is opened and is kept in an open state ($L_3$) for a third predetermined period of time ($\Delta t_3$) including the instant ($t_2$) when the piston (2) reaches its bottom dead center position (BDC).

4. The method according to claim 1, wherein during said second timing sequence, an intake valve (41, 42) is opened and is kept in an open state ($L_{41}$) for a fourth predetermined period of time ($\Delta t_{41}$), after said second period of time ($\Delta t_2$) and prior to a second instant ($t_2$) when said piston reaches its bottom dead center position (BDC).

5. An internal combustion engine capable of operating in either positive mode or braking mode, said engine comprising a plurality of cylinders (1), each of which is provided with a piston (2), at least one intake valve (41, 42) and at least one exhaust valve (43, 44) and control means (6) for said valves (4), said control means being adapted to establish a first four-stroke timing sequence of the valves of each cylinder for the positive mode of said engine and a second two-stroke timing sequence of said valves for the braking mode of said engine, said control means piloting said valves in said second timing sequence so that at least a first exhaust valve (43) of each cylinder is opened prior ($t_0$) to a first instant ($t_1$) where the piston (2) of a cylinder reaches its top dead center position (TDC) characterized in that, during said second timing sequence, said control means (6) pilot said exhaust valves (4) so that:

said first exhaust valve (43) is kept in an open state, with a first lift ($L_1$) and for a predetermined period of time ($\Delta t_1$), prior to said first instant ($t_1$), and at least an exhaust valve (43 or 44) is kept in an open state, with a second lift ($L_2$) higher than said first lift and for a second predetermined period of time ($\Delta t_2$), after said first instant, wherein during said second timing sequence, said control means (6) close said first exhaust valve (43) after said first period ($\Delta t_1$), and open a second exhaust valve (44) before said first instant ($t_1$), said second valve being kept in its open state ($L_2$) during said second predetermined period of time ($\Delta t_2$).

* * * * *